US010753349B2

(12) United States Patent
Hebrard

(10) Patent No.: US 10,753,349 B2
(45) Date of Patent: Aug. 25, 2020

(54) COMPRESSOR WITH ADAPTABLE TRANSMISSION WITH RESPECT TO THE MOTIVE SOURCE

(71) Applicant: KNORR-BREMSE Systeme fuer Nutzfahrzeuge GmbH, Munich (DE)

(72) Inventor: Gilles Hebrard, Caen (FR)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 262 days.

(21) Appl. No.: 15/527,187

(22) PCT Filed: Nov. 16, 2015

(86) PCT No.: PCT/EP2015/076636
§ 371 (c)(1),
(2) Date: Sep. 8, 2017

(87) PCT Pub. No.: WO2016/079031
PCT Pub. Date: May 26, 2016

(65) Prior Publication Data

US 2018/0291883 A1 Oct. 11, 2018

(30) Foreign Application Priority Data

Nov. 17, 2014 (DE) ..... 10 2014 116 805

(51) Int. Cl.
*F04B 35/01* (2006.01)
*F04B 39/00* (2006.01)
(Continued)

(52) U.S. Cl.
CPC ..... *F04B 35/01* (2013.01); *F02B 67/04* (2013.01); *F04B 9/02* (2013.01); *F04B 39/0094* (2013.01); *F02F 7/0019* (2013.01)

(58) Field of Classification Search
CPC .. F02B 67/04; F04B 9/02; F04B 35/01; F04B 39/0094
(Continued)

(56) References Cited

U.S. PATENT DOCUMENTS 4,848,213 A 7/1989 Wood et al.
4,952,123 A 8/1990 Gebhardt
(Continued)

FOREIGN PATENT DOCUMENTS

DE 2 302 800 7/1974
DE 38 04 574 A1 8/1989
(Continued)

OTHER PUBLICATIONS

International Search Report (PCT/ISA/210) issued in PCT Application No. PCT/EP2015/076636 dated Feb. 23, 2016 with English translation (seven pages).
(Continued)

*Primary Examiner* — Nathaniel E Wiehe
*Assistant Examiner* — Richard C Drake
(74) *Attorney, Agent, or Firm* — Crowell & Moring LLP

(57) ABSTRACT

A compressor has a crankcase in which a crankshaft is rotatably mounted in a crankspace. The crankcase contains at least one cylinder space in which a piston, mounted eccentrically on the crankshaft by way of a connecting rod, can be driven in reciprocating motion. The crankshaft is connected, via a gearing having a modulus m, to a drive source, wherein the gear wheel arranged on the crankshaft engages with the gear wheel on the drive source. The axis of rotation of the crankshaft is offset with respect to the center axis of the cylinder space by an amount dl which is a whole multiple of m/2. The center axis of the cylinder space is understood as the axis which proceeds from the center point of the base area of the cylinder space, perpendicular to this
(Continued)

base area, and along which the piston moves. This makes it possible to change the transmission ratio of the gearing within an advantageous range, without it being necessary to undertake modifications to the external dimensions of the compressor or to the motive source. Depending on the transmission ratio, it is possible to reduce the operating noise of the compressor or to increase the air capacity.

11 Claims, 2 Drawing Sheets

(51) Int. Cl.
*F02B 67/04* (2006.01)
*F04B 9/02* (2006.01)
*F02F 7/00* (2006.01)

(58) Field of Classification Search
USPC ..... 92/261; 417/380, 437
See application file for complete search history.

(56) References Cited

U.S. PATENT DOCUMENTS 4,974,557 A 12/1990 Gebhardt
5,215,447 A * 6/1993 Wen ..... F04B 9/06 417/319
5,378,123 A * 1/1995 Scuderi ..... F25B 45/00 417/415
8,522,833 B2 * 9/2013 Chou ..... F04B 35/008 141/38
9,956,730 B2 * 5/2018 Kono ..... F04B 11/0008
2004/0129244 A1 * 7/2004 Beaudoin ..... F01C 1/077 123/242
2007/0264139 A1 * 11/2007 Chou ..... F04B 9/045 417/415
2008/0133113 A1 * 6/2008 Yasui ..... F01L 1/352 701/105
2008/0247890 A1 * 10/2008 Kubota ..... F04B 39/0094 417/437
2016/0333776 A1 * 11/2016 Andersson ..... F02B 33/22
2017/0350476 A1 * 12/2017 Spindler ..... B29C 73/166

FOREIGN PATENT DOCUMENTS

DE 10 2011 015 720 A1 10/2012
GB 1 436 273 5/1976
JP 56-120377 U 9/1981
JP 2-11828 A 1/1990
WO WO 88/07620 A1 10/1988

OTHER PUBLICATIONS

German-language Written Opinion (PCT/ISA/237) issued in PCT Application No. PCT/EP2015/076636 dated Feb. 23, 2016 (six pages).

* cited by examiner

COMPRESSOR WITH ADAPTABLE TRANSMISSION WITH RESPECT TO THE MOTIVE SOURCE

FIELD OF THE INVENTION

The invention relates to a compressor which is connected to a drive source by way of a transmission ratio.

BACKGROUND AND SUMMARY OF THE INVENTION

Air compressors for commercial vehicles as a rule convert a rotational movement of at least one piston, which rotational movement is provided by the drive source (engine), which piston moves up and down in a cylinder and compresses the air during said movement. Said conversion takes place by way of a connecting rod which is mounted rotatably on the piston by way of a connecting rod eye and which is mounted on a crankshaft such that it can be rotated eccentrically by way of another connecting rod eye. The crankshaft is set in rotation by the drive source by way of a transmission ratio. The transmission ratio is constant, with the result that the operating speed of the compressor changes with the engine rotational speed.

The compressor is generally designed in such a way that it can still deliver the required compressed air requirement of the vehicle at its system pressure, even during idling of the vehicle engine. Here, the compressor has to fit into an installation volume which is predefined by the vehicle design, and the crankshaft has to have a gearwheel for the transmission of power, which gearwheel fits into a gearwheel which is present on the drive source. The operating parameters of the compressor are therefore specified to a more or less fixed extent and have to be accepted by the user, even if they should not be optimum with regard to noise or energy consumption.

SUMMARY OF THE INVENTION

There is therefore needed a compressor which can be configured with more advantageous operating parameters in the case of a specification of a specific installation space in the engine compartment and a specific gearwheel on the drive source for the transmission of power. According to the invention, said need is met by way of a compressor according to embodiments of the invention.

A compressor has been developed within the context of the invention. Said compressor has a crankcase, in which a crankshaft is mounted rotatably in a crank chamber. The crankcase contains at least one cylinder space, in which a piston which is mounted eccentrically on the crankshaft by way of a connecting rod can be induced to perform a to and fro movement. The crankshaft is connected to a drive source by way of a gearwheel mechanism which has a modulus m, by the gearwheel which is arranged on the crankshaft engaging into the gearwheel on the drive source.

According to the invention, the rotational axis of the crankshaft is offset with respect to the center axis of the cylinder space by a value dl which is an integral multiple of m/2. The center axis of the cylinder space is understood to mean the axis which emanates from the center point of the base area of the cylinder space perpendicularly with respect to said base area, along which axis the piston moves.

It has been recognized that the transmission ratio of the gear mechanism can be changed into an advantageous range in this way, without it being necessary to make changes to the external dimensions of the compressor or to the drive source. In particular, the gearwheel of the drive source does not have to be changed.

If the gearwheel of the drive source has a number Z1 of teeth and the gearwheel of the crankshaft which engages into it has a number Z2 of teeth, the spacing of the rotational axes of the gearwheels is given by m*(Z1+Z2)/2, in which m is the modulus of the gear mechanism. Said modulus is a measure for the size of the teeth. By the claimed offset being introduced between the rotational axis of the crankshaft and the center axis of the cylinder space, the tooth number Z2 of the gearwheel on the crankshaft and therefore also the transmission ratio of the gear mechanism can be changed, without it being necessary to make changes to the drive source. It is precisely the case in the claimed offset that the number of teeth remains an integer, with the result that complicated adaptation measures for the gearwheels are dispensed with. Therefore, the claimed feature of the integral multiple of m/2 is not even to be interpreted in a purely mathematical manner, but rather also expressly includes spacings dl which differ from an integral multiple of m/2 only to such an extent that the gearwheel of the crankshaft can still engage, without changes to the size of the teeth, into the gearwheel of the drive source for the purpose of the transmission of power, within the mechanical tolerances.

Here, the gear mechanism advantageously has a transmission ratio of between 1 to 0.9 and 1 to 1.1 from the drive source to the crankshaft. The typical engines for heavy commercial vehicles provide a gearwheel with a modulus value of between 1.5 and 3.5 mm for the drive of a compressor. Therefore, the transmission ratio per tooth, by which the tooth number Z2 of the gearwheel on the crankshaft is changed, can be changed by from 2 to 3%.

According to the prior art, the tooth numbers of both gearwheels have been identical, that is to say Z1=Z2. If Z2 is now increased beyond Z1, the piston moves more slowly in the compressor. In this way, the operating noise of the compressor can be reduced, at the cost of the air delivery per unit time also decreasing.

The transmission ratio is therefore advantageously greater than 1, that is to say Z2 is smaller than Z1. The piston of the compressor then moves more rapidly. In the case of given specifications for the air delivery per time unit (for example, 200 liters per minute at 12 bar system pressure and 700 revolutions per minute of the engine), less piston stroke in the cylinder is then required to produce this performance. The compressor can be of more compact configuration. On account of the constricted space conditions in the engine compartment, the piston displacement is a constant bottleneck. Only from 360 to 400 $cm^3$ per cylinder are typically available.

The connecting rod eye of the connecting rod, which connecting rod eye is mounted rotatably with respect to the crankshaft, can advantageously be moved freely in a circle about the axis of the crankshaft. The wear as a result of bearing forces is then particularly low. Furthermore, this embodiment requires particularly little space in the crank chamber of the crankcase.

The rotational axis of the crankshaft is advantageously offset with respect to the center axis of the cylinder space by a value dl of between 1 and 5 mm, preferably between 2 and 3 mm. The effect can then additionally be utilized that the deflection of the connecting rod out of the center axis of the cylinder is reduced during the rotation of the crankshaft about its axis. Said deflection loads the piston with a force component which presses against the wall of the cylinder and therefore increases the wear as a result of friction between the cylinder and the piston.

In general, the invention affords the advantage that compressors with a limited range of performance classes can be manufactured less expensively with a high proportion of identical parts. In order to set the performance, merely the offset dl between the rotational axis of the crankshaft and the center axis of the cylinder has to be adapted.

BRIEF DESCRIPTION OF THE DRAWINGS

In the following text, the subject matter of the invention will be explained using figures, without the subject matter of the invention being restricted as a result.

DETAILED DESCRIPTION OF THE DRAWINGS

Figure 1:
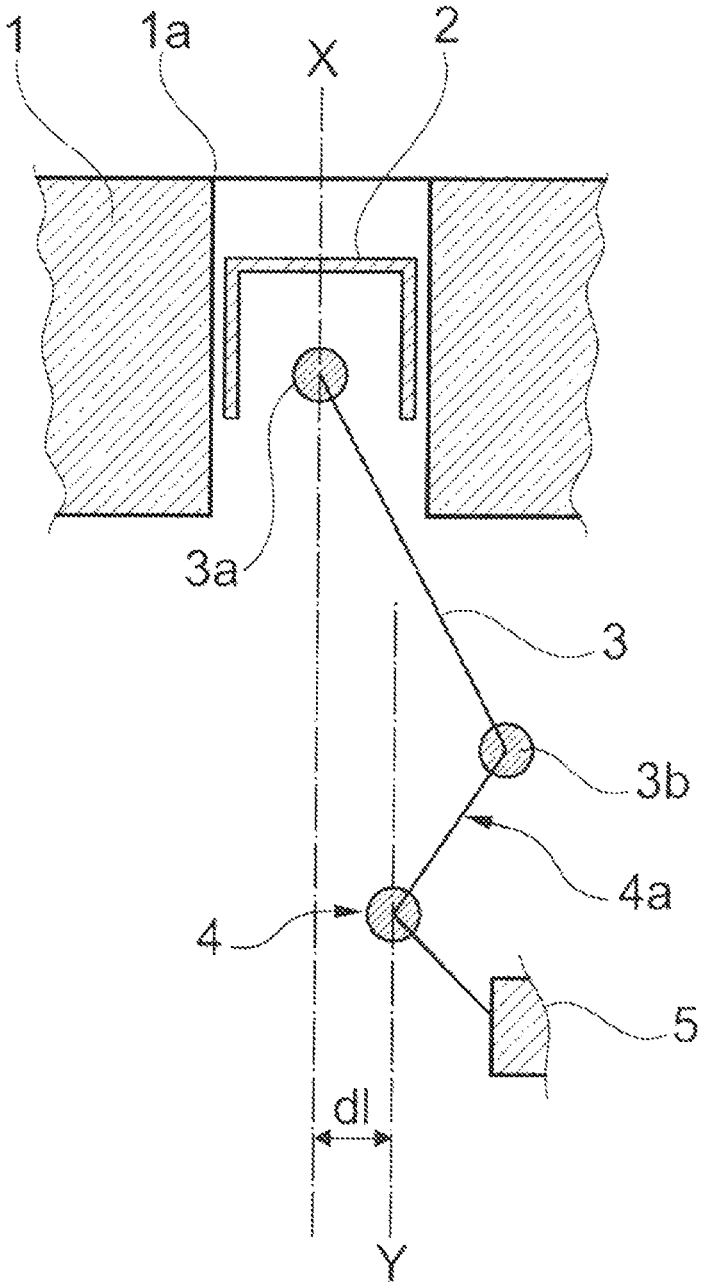
FIG. 1 shows an outline sketch of the compressor according to the invention with an offset between the crankshaft and the center axis of the cylinder space.

FIG. 1 shows an outline sketch of a compressor according to the invention. A cylinder bore 1*a* is situated in the crankcase 1, 5. The center axis of said cylinder bore 1*a* is denoted by X. A piston 2 moves in the cylinder bore. Said piston 2 is connected to the crankshaft 4 via a connecting rod 3. The connecting rod has two connecting rod eyes 3*a* and 3*b*. The upper connecting rod eye 3*a* is mounted rotatably with respect to the piston 2. The lower connecting rod eye 3*b* is mounted rotatably with respect to a crankpin 4*a* which rotates with the crankshaft 4 about its center axis Y. When the crankshaft 4 rotates, the lower connecting rod eye 3*b* of the connecting rod 3 describes a circle about the center axis Y of the crankshaft 4. The axes X and Y run perpendicularly with respect to one another, the axis X runs in the plane of the drawing, and the axis Y runs perpendicularly with respect to the plane of the drawing. Both axes are displaced with respect to one another in parallel by a value dl, however. The crankshaft 4 is mounted rotatably with respect to the part 5 of the crankcase 1, 5.

Figure 2:
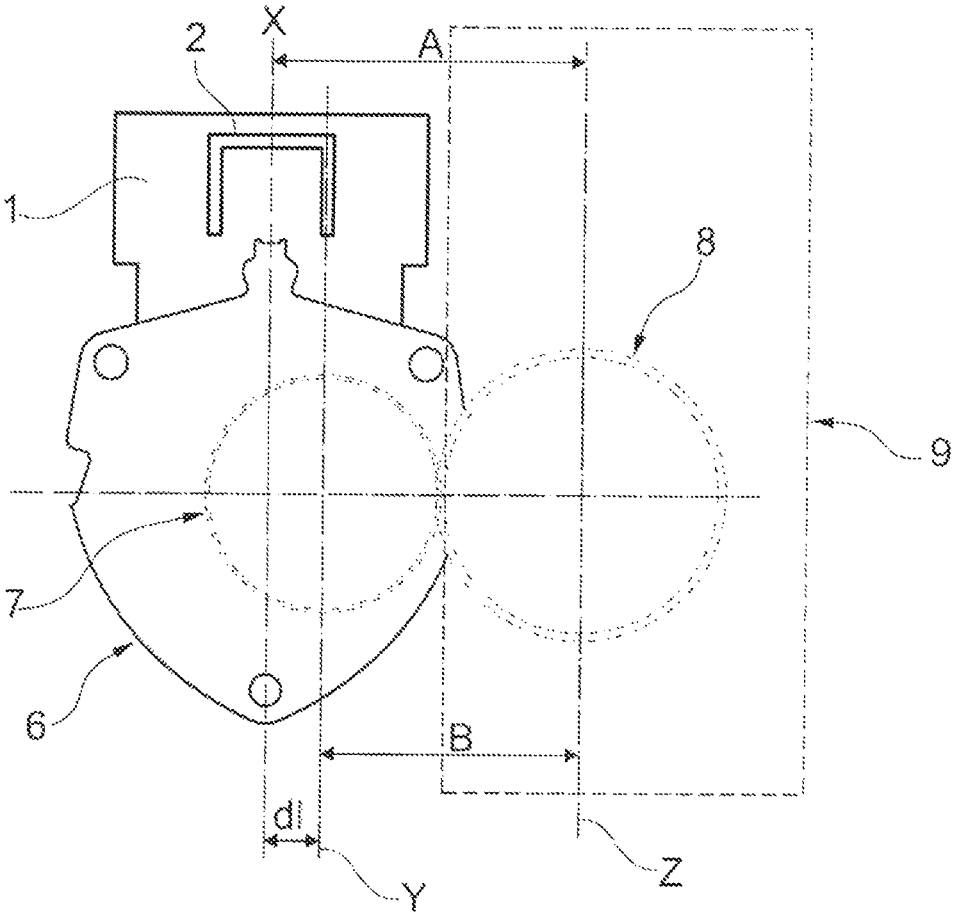
FIG. 2 shows the integration of a compressor according to the invention into a predefined engine compartment.

The effect of the parallel displacement dl is shown in the case of the integration of the compressor into an engine compartment in accordance with FIG. 2. The engine block 9 is situated with fixed dimensions at a predefined location, which engine block 9 provides a predefined gearwheel 8 for the drive of the compressor. The gearwheel rotates about an axis Z which lies perpendicularly on the plane of the drawing and is at a spacing A from the center axis X of the cylinder space, which center axis X runs in the plane of the drawing. The crankshaft 4 is driven by a gearwheel 7 which engages into the gearwheel 8 on the engine block 9. Said gearwheel 7 rotates about the axis Y which is the axis of symmetry of the crankshaft 4 and lies perpendicularly on the plane of the drawing. The axes Y and Z are at a spacing B from one another which is smaller than the spacing A. Therefore, the gearwheel 7 has a number Z2 of teeth which is smaller than the tooth number Z1 of the gearwheel 8 on the engine block 9. The gearwheel 7 therefore rotates more rapidly than the gearwheel 8. As a result, the compressor ejects a greater air volume per unit time. This change has been brought about without it being necessary to have made a change to the dimensions and form factor of the compressor. The flange 6, by way of which said compressor is mounted in the engine compartment, is also situated at the same location as in the case of a compressor in accordance with the prior art, the gearwheel 7 of which was exactly as large as the gearwheel 8.

What is claimed is:

1. A compressor, comprising:

a crankcase;

a crankshaft mounted rotatably in a crank chamber of the crankcase, the crankcase containing at least one cylinder space, in which a piston which is mounted eccentrically on the crankshaft by way of a connecting rod performs a reciprocating movement;

a gearwheel mechanism by which the crankshaft is connectable to a drive source, the gearwheel mechanism having a modulus m, wherein the gearwheel which is arranged on the crankshaft engages into the gearwheel of the drive source, and a rotational axis of the crankshaft is offset with respect to a center axis of the cylinder space by a value dl which is an integral multiple of m/2 or which differs from the integral multiple of m/2 only to such an extent that the gearwheel which is arranged on the crankshaft can still engage, without changes to a size of teeth of the gearwheel which is arranged on the crankshaft, into the gearwheel of the drive source for a purpose of a transmission of power, within mechanical tolerances.

2. The compressor as claimed in claim 1, wherein the gearwheel mechanism has a transmission ratio between 1:0.9 and 1:1.1 from the drive source to the crankshaft.

3. The compressor as claimed in claim 2, wherein the transmission ratio is greater than 1.

4. The compressor as claimed in claim 1, wherein a transmission ratio of the gearwheel mechanism is greater than 1.

5. The compressor as claimed in claim 1, wherein the connecting rod eye of the connecting rod, which connecting rod eye is mounted rotatably with respect to the crankshaft, is movable freely in a circle about the axis of the crankshaft.

6. The compressor as claimed in claim 2, wherein the connecting rod eye of the connecting rod, which connecting rod eye is mounted rotatably with respect to the crankshaft, is movable freely in a circle about the axis of the crankshaft.

7. The compressor as claimed in claim 1, wherein the rotational axis of the crankshaft is offset with respect to the center axis of the cylinder space by a value dl of between 1 and 5 mm.

8. The compressor as claimed in claim 7, wherein the value dl is between 2 and 3 mm.

9. The compressor as claimed in claim 2, wherein the rotational axis of the crankshaft is offset with respect to the center axis of the cylinder space by a value dl of between 1 and 5 mm.

10. The compressor as claimed in claim 4, wherein the rotational axis of the crankshaft is offset with respect to the center axis of the cylinder space by a value dl of between 1 and 5 mm.

11. The compressor as claimed in claim 5, wherein the rotational axis of the crankshaft is offset with respect to the center axis of the cylinder space by a value dl of between 1 and 5 mm.

* * * * *